US005148972A

United States Patent [19]

Clayton

[11] Patent Number: 5,148,972

[45] Date of Patent: Sep. 22, 1992

[54] FAST FOOD CONTAINER

[76] Inventor: Robert E. Clayton, 1429 Laurel Hill Rd., Vienna, Va. 22182

[21] Appl. No.: 734,151

[22] Filed: Jul. 22, 1991

[51] Int. Cl.[5] ..... B65D 5/30

[52] U.S. Cl. ..... 229/113; 229/349; 229/222; 229/DIG. 13

[58] Field of Search ..... 229/221, 222, 243, 113, 229/DIG. 13, 149, 8, 103; 426/115, 128; 220/676

[56] References Cited

U.S. PATENT DOCUMENTS

| | | | |
|---|---|---|---|
| 2,771,232 | 11/1956 | Reed | 229/915 |
| 2,865,549 | 12/1958 | Inman | 229/149 |
| 3,094,264 | 6/1963 | Petrone | 229/DIG. 13 |
| 3,355,082 | 11/1967 | Wood | 229/8 |
| 3,580,484 | 5/1971 | Schneider | 229/243 |
| 3,610,512 | 10/1971 | Hermaba | 229/902 |
| 3,899,126 | 8/1975 | Palmer | 229/222 |
| 3,949,931 | 4/1976 | Hall | 229/102 |
| 4,183,436 | 1/1980 | Engelhardt et al. | 229/221 |
| 4,189,054 | 2/1980 | Liu et al. | 229/DIG. 13 |
| 4,232,816 | 11/1980 | Johnson et al. | 229/149 |
| 4,326,356 | 4/1982 | Mason | 229/103 |
| 4,344,537 | 8/1982 | Austin | 229/243 |
| 4,405,044 | 9/1983 | Flower et al. | 229/221 |
| 4,472,896 | 9/1984 | Brauner et al. | 229/902 |
| 4,511,039 | 4/1985 | Siemek | 426/115 |
| 4,585,124 | 4/1986 | Pride | 426/115 |
| 4,641,752 | 2/1987 | Palffy | 426/115 |
| 4,684,023 | 8/1987 | Cortopassi | 229/8 |
| 4,760,950 | 8/1988 | Levick | 229/103 |
| 4,838,424 | 6/1989 | Petzelt | 229/221 |
| 5,042,666 | 8/1991 | Dolenc | 426/115 |

*Primary Examiner*—Stephen Marcus
*Assistant Examiner*—Christopher J. McDonald
*Attorney, Agent, or Firm*—Jon L. Roberts

[57] ABSTRACT

A food container for holding fast food or other similar article is disclosed. The container is constructed from a cardboard blank which is cut and scored to define a top and bottom portion joined by a common back panel which is hinged. The bottom side panels each contain a single punch out tab whereby a user can insert his thumb to underlie the food article being consumed with his other fingers gripping the top of the food item to be consumed. The container further comprises a flip down front panel scored to a level above the bottom of the food container thereby allowing access to the food item for consumption yet not allowing juices from the food item to emerge from the food container.

6 Claims, 3 Drawing Sheets

FAST FOOD CONTAINER

FIELD OF INVENTION

The present invention relates generally to a container/container for transporting food items and facilitating consumption of those items without removing such items from the described container.

BACKGROUND OF THE INVENTION

The advent of modern fast-paced lifestyles often requires consumers of so called fast-food or take-out orders to consume food items purchased while driving, standing, or seated in areas where no table-like support or other dining accommodations are available. As a result, it is often difficult to manage food items while eating and to prevent excess crumbs, condiment, or natural juices from falling or dripping on the consumer.

The objective of the invention described herein is to provide a disposable and inexpensive container for packaging fast food sandwiches that allows a consumer to hold, manage, and consume the contained food article without removing it from its container. Such a container allows the consumer to insert his thumb through a perforated punch out opening in the container side panels and hold and manipulate the contained food article from its bottom. With the container in its open position, the consumer may hold the top of the food article with his remaining fingers using the little finger behind the container hinge to steady the container. Such a container, by facilitating consumption of the contained food article without removing it from its container, confines crumbs, excess condiment, and natural juice drippings to the container and prevents such unconsumed residue from falling or dripping on the consumer.

The container may be constructed from either cardboard or other recyclable material, (cut, scored, and perforated to permit a folded container), molded styrofoam, or any other biodegradable packaging material.

U.S. Pat. No. 4,760,950 to Levick describes a holder for a pita bread sandwich constructed from a cardboard blank cut and scored such that when folded, the resulting structure defines a semicircular pocket open at the top for receiving and holding a pita bread sandwich. The semicircular structure is supported for standing upright on a table by two outer panels. However, this structure only defines a container for holding the pita sandwich and does not facilitate consumption of the pita sandwich without removal from the pita holder.

U.S. Pat. No. 4,684,023 to Cortopassi describes a multi-purpose folding paper board container incorporating content-identifying elements enabling identification of the container contents without necessitating the opening of the container. Again, however, such a container does not permit consumption of the food article contained therein without removal from the container.

U.S. Pat. No. 4,189,054 to Liu et al. describes a circular apparatus for holding a food product where the upper half of the circular casing can be folded back to an open position to facilitate consumption of the food product. However, such a container does not permit the consumer to insert his fingers into the container and manage the food item during consumption. Further this container has no provision to catch food crumbs or drippings from the food item being consumed.

U.S. Pat. No. 3,955,710 to Commisso, describes a thin plastic cover designed with a lower locking rim expandable in diameter when locked over the periphery of a circular plate. The primary purpose of such a device is to keep food warm and sanitary is not to facilitate consumption of the covered food article without removal from the plate covered.

U.S. Pat. No. 3,355,082 to Wood describes containers for food products permitting consumption of the food product directly from the container. However, one of the main stated objectives of the invention is to provide a container which prevents any contact of the fingers with the food product in the course of its consumption from the container. Therefore, such container does not enhance manageability of the food article during consumption.

U.S. Pat. No. 3,094,264 to Petrone describes a portable tray for both a beverage and a food article. However, the invention provides proper control and support for the beverage and the food product for transport purposes only and does not facilitate consumption of the food articles directly from the container.

U.S. Pat. No. 2,771,232 to Reed describes a portable tray for supporting and carrying articles such as ice cream cones and sandwiches. The described invention however does not permit consumption of the food articles contained therein directly from the container without removal from the container.

U.S. Pat. No. 4,326,356 to Mason describes a rectangular sheet of self-supporting material cut and scored in a manner as to be foldable into a fast food carry out tray which can be converted after use into a hand puppet. However, similar to the above-mentioned inventions, the described container does not permit consumption of food directly from the container.

U.S. Pat. No. 2,283,704 to Steudel describes a display holder for bakery goods. The primary purpose of the described receptacle is to provide ventilation for bakery products placed in the receptacle such that vapors and warm air or gases escape preventing the crust of the baked goods from becoming saturated and soggy. Again, a primary objective of the described receptacle is not consumption of the baked goods contained therein without removal from the receptacle.

SUMMARY OF THE INVENTION

The present invention contemplates a stamped blank of foldable material comprising a top portion and a bottom portion scored and perforated such that when the distinct panels created and hinged as a result of such scoring are folded and assembled to adjacent panels by way of tuck-tabs, heat sealed or adhesive tabs or other means common in the trade, a closable container is formed. Two perforated fold out tabs positioned in the center of both bottom side panels of the container and a small distance above the floor of the bottom half of the container permit a consumer to insert his fingers into the container and hold the enclosed food article from its bottom. With the upper half of the container open, the consumer may hold the top of the enclosed food article with his remaining fingers using the little finger at the near panel hinge to steady the container.

Such a container will eliminate the need to remove the food article from the container for consumption. The container will therefore permit consumption of the food article and at the same time confine crumbs, excess condiment, and natural juices and prevent this unconsumed residue from falling or dripping onto the consumer.

DETAILED DESCRIPTION

Figure 1:
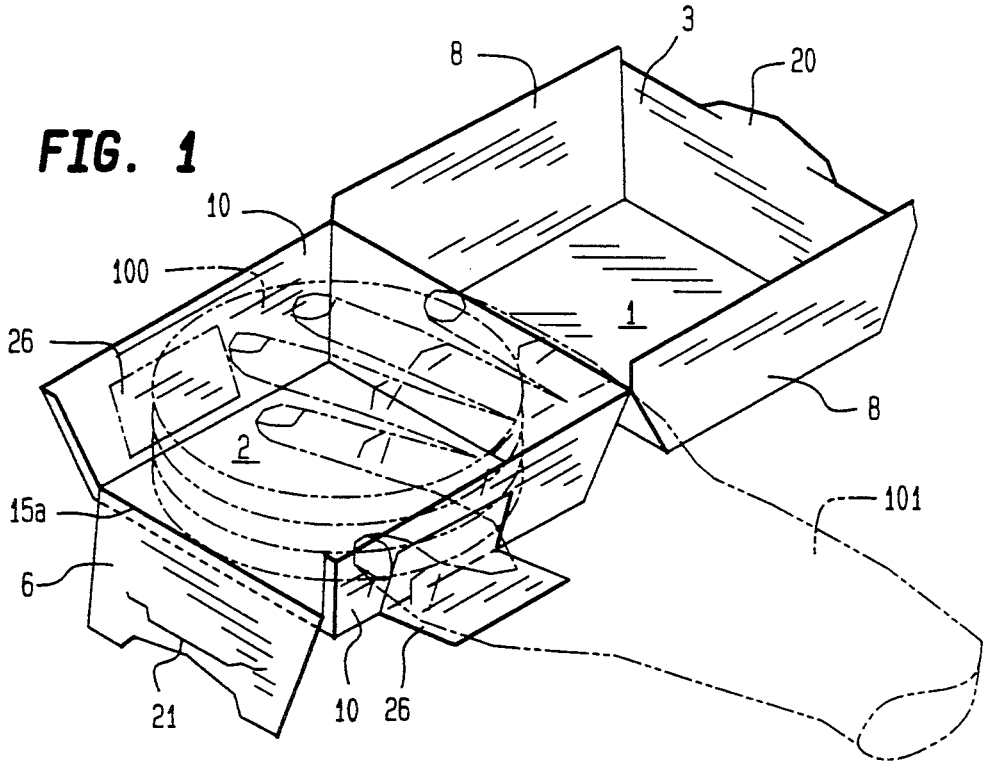
FIG. 1 illustrates the fully assembled container with perforated fold out tabs in their open position further showing the position of the food and the consumer's hand.

Referring to FIG. 1 the fully assembled container with the perforated fold out tabs in the open position as described. The consumer [101] accesses the food item [100] by inserting his thumb through the side punch out tab [26] and gripping the top of the food item with his fingers. While eating the food, bottom front panel [6] is folded down thereby allowing the food to be managed and eaten. It should be noted that the bottom front panel [6] is not perforated all the way to the bottom of the container. Folded line [15*a*] is used as the bottom limit after fold-down portion of the bottom front panel [6], thereby allowing a lip which can catch and contain any juice from the food item being consumed.

Figure 2:
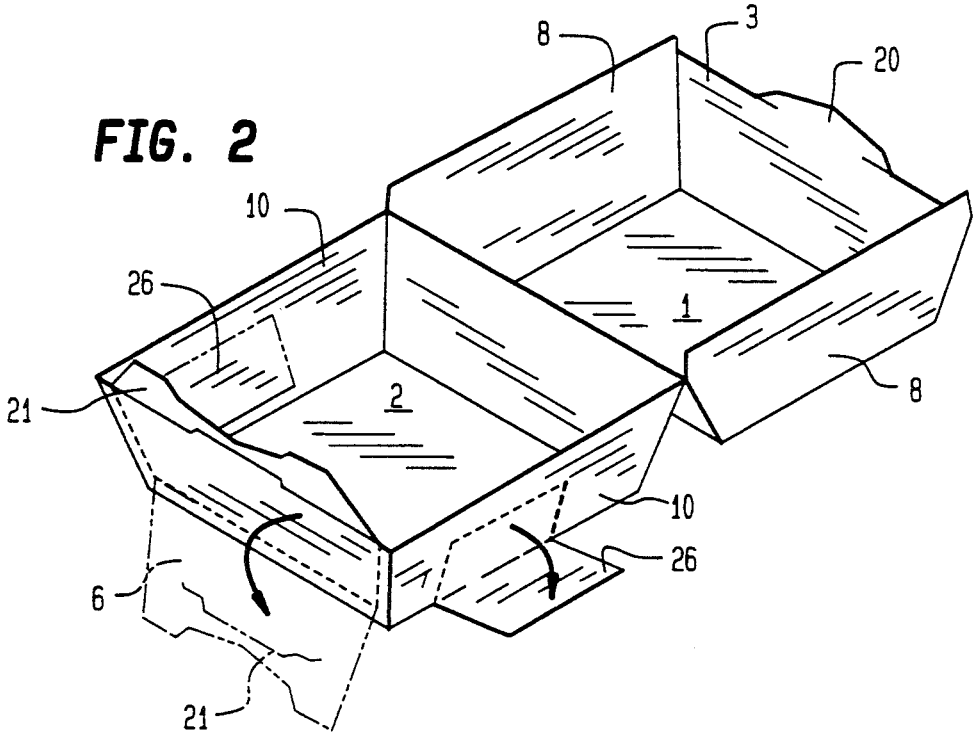
FIG. 2 illustrates the fully assembled container with perforated fold out tabs in their folded open position.
Figure 4:
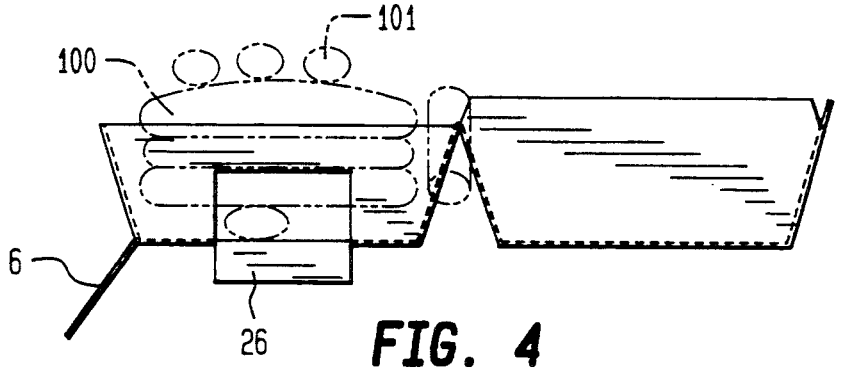
FIG. 4 illustrates a side-view of the container in its fully opened position with finger inserted through a perforated fold out opening holding the enclosed food article.

FIG. 2 displays the container in its fully erected and opened position. Perforated punch out tabs [26] positioned on both bottom side panels of the erected container, may be punched out and folded providing an opening for inserting the consumer's thumb. In its fully opened position and with the consumer's thumb inserted through the opening provided by punch out tab [26], the food article contained in the box can be held from both its top and bottom as illustrated in FIGS. 1 and 4. The supported food article may then be managed and consumed without removal from its container. It should be noted that the punch out tabs may also contain a small cut out at the top of the tab to allow the user to insert the tip of a finger to pull the tab to its folded-out position.

Figure 3:
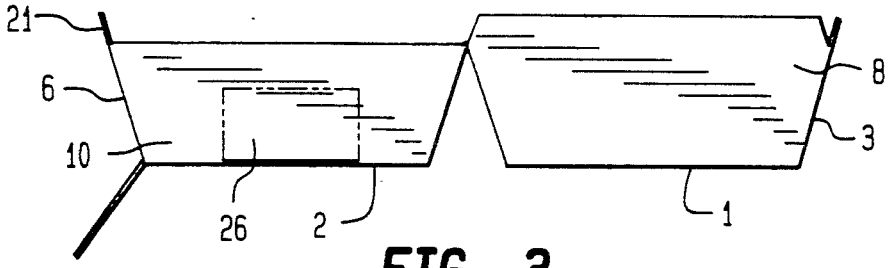
FIG. 3 illustrates the side view of the assembled container including the perforated side opening.

Referring to FIG. 3 a side view of the container is shown. In this figure the perforated punch out tab [26] is shown prior to it being punched out to allow access by the fingers of the user.

Referring to FIG. 4 a side view of the container is shown together with the user's hand positioned around the food item to be consumed. In this figure the bottom front panel [6] is in the folded down position thereby allowing access to the food item [100] being held by the consumer [101]. The location of the user's small finger at the center fold of the container is shown providing further stability to the holding of the box.

Figure 5:
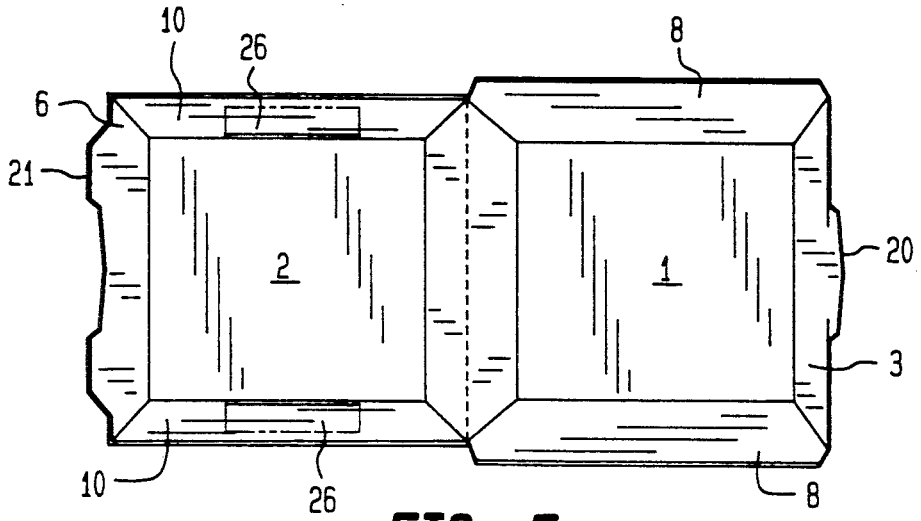
FIG. 5 illustrates a top view of the assembled container.

Referring to FIG. 5 the top view of the assembled container is shown. In this figure, punch out tabs [26] are in the original (i.e. not unfolded) position, as is the bottom front panel [6].

Figure 6:
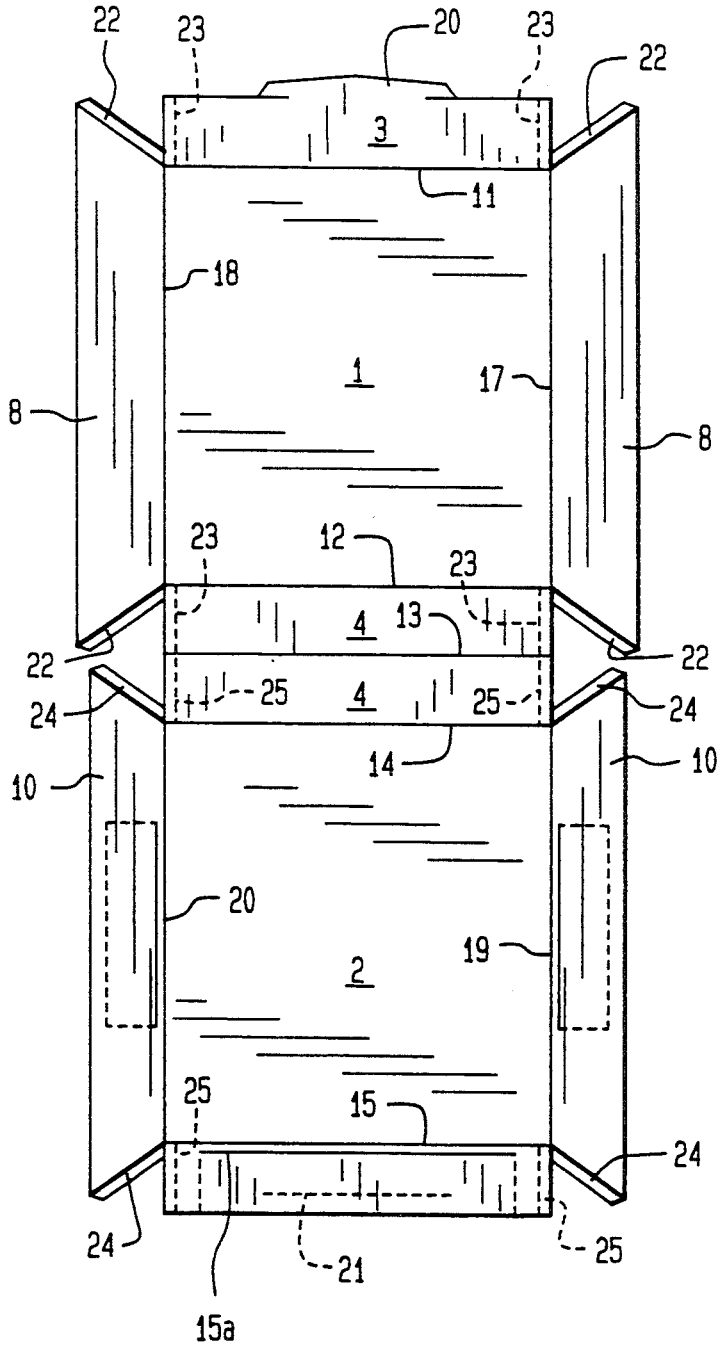
FIG. 6 illustrates a plan view of the unfolded die-cut blank.

Referring to FIG. 6, the container blank for forming the container is shown comprising a one piece, die-cut flat structure which may have various surface textures, glossy or decorative in nature. The blank consists of top panel [1], bottom panel [2], top front panel [3], rear panel [4] (shared between the top portion and bottom portion of the container) and bottom front panel [6] which are hinged together along fold lines [11, 12, 13, 14, and 15] by virtue of score lines in the material. Top panel [1] constitutes the top of the container, bottom panel [2] the bottom of the container, rear panel [4] constitutes the rear panel of the container, panel [3] constitute the top front panel, and panel [6] bottom front panel. Extending on either side of top panel [1] are parallel top side panels [8]. Similarly, extending from either side of bottom panel [2] are parallel bottom side panels [10]. The edge of top panel [1] opposite hinge line [11] has top front panel [3] joined to top panel [1] such that when folded along hinge line [11] upon closing of the container, a closure flap is formed holding the erected container in its closed position when tongue [20] is inserted into perforated slot [21] located on bottom front panel [6].

In order to erect the container, parallel top side panels [8] are folded along fold lines [18] and [17], top front panel [3] and rear panel [4] are folded along fold lines [11] and [12] respectively and tabs [22] are inserted into perforated slots [23] or otherwise affixed to panels [3 and 4] to form the top portion of the container. Similarly, the bottom portion of the container is constructed by folding parallel side panels [10] along fold lines [19] and [20] and folding rear panels [4] and bottom front panel [6] along fold lines [14 and 15] respectively. The bottom portion is held in its erected condition by virtue of tabs [24] being inserted into perforated slots [25] or otherwise affixed to the bottom front and rear panels [5 and 6]. The upper and lower portions of the container are interconnected along fold line [13] on rear panel [4] serving as the hinge for opening and closing the erected container. The erected container is held in its closed position by inserting tongue [20] into perforated slot [21].

From the foregoing description, it is apparent that the invention is a simple but novel construction for facilitating consumption of fast food items without removing such items from their container. While there have been shown and described preferred embodiments according to the invention, it is to be understood that there are other modifications and adaptations that may be made within the spirit and scope of the invention. For example tabs [22] and [24] may be affixed to the various front and rear panels by adhesive or heat sealing versus tuck tabs and slots shown and punch out tabs allowing finger access may be of different sizes and shapes. Other modifications within the spirit an scope of the invention will be apparent to those skilled in the art.

What is claimed is:

1. A food container for supporting and managing the consumption of food items comprising;

a top and a bottom portion;

said top portion comprising a top front panel, parallel top side panels having narrow ends, a rear panel, and a top panel;

said parallel top side panels having top tabs extending from said narrow ends for attaching said parallel top side panels to said top front panels and to said rear panel when assembled to form the top portion of the food container;

said rear panel being shared with said top and bottom portions of the container, and being opposed to the top front panel;

said top panel having first and second sets of parallel fold lines, said first set of parallel fold lines allowing said parallel top side panels to be folded and said second set of parallel fold lines allowing said top front and said rear panel to be folded so as to come into contact with and be affixed to said parallel top side panels;

said rear panel having an additional fold line which divides the top and bottom portions of the container and which further provides a hinge between said top and bottom portions of the food container;

said bottom portion comprising parallel bottom side panels having narrow ends, a bottom front panel and a bottom panel;

said parallel bottom side panels having bottom tabs extending from said last mentioned narrow ends for attaching said parallel bottom side panels to said bottom front panel and to said rear panel when assembled to form the bottom portion of the food container;

said bottom panel comprising third and fourth sets of parallel fold lines, said third set of parallel fold lines allowing the parallel bottom side panels to be folded and said fourth set of parallel fold lines allowing the bottom front and rear panels to be folded to come into contact with and be affixed to the parallel bottom side panels.

said parallel bottom side panels further comprising punch out tabs created by scoring a portion of said parallel bottom side panels to allow said punch out tabs to be folded out from said parallel bottom side panels, said punch out tabs further comprising fold lines fold lines parallel to and relatively above said third set of parallel fold lines;

said bottom front panel further comprising perforated lines perpendicular to the fourth set of fold lines to allow the bottom front panel to be separated from and folded down from the food container, and further comprising an additional fold line, parallel to but relatively above one of said fourth set of parallel fold lines.

2. The food container according to claim 1 wherein the top and bottom tabs are selected from the group comprising tuck tabs, adhesive tabs, and heat shrinkable tabs for attaching said side panels to said top front, bottom front, and said rear panel of said container.

3. The food container according to claim 2 further comprising a top front panel tongue and bottom front panel slot into which the top front panel tongue is inserted in order to close the said food container.

4. The food container according to claim 3 wherein said punch out tabs are from the group of shapes comprising semi circular, rectangular, and trapezoidal shaped perforated openings.

5. The food container according to claim 4 wherein said food container is constructed from a unitary blank.

6. The food container according to claim 5 wherein said punch out tabs comprise a cut-out portion at the top of each tab allow a user to insert the tip of a finger to pull out the said punch out tab.

* * * * *